US008371900B2

(12) United States Patent
Haass et al.

(10) Patent No.: US 8,371,900 B2
(45) Date of Patent: Feb. 12, 2013

(54) METHOD FOR SWITCHING POINTS IN A DIGITAL CONTROL SYSTEM FOR TRACK-GUIDED TOY VEHICLES

(75) Inventors: Uwe Haass, Darmstadt (DE); Roman Missler, Lebach (DE)

(73) Assignee: Stadlbauer Spiel-und Freizeitartikel GmbH, Nuremberg (DE)

( * ) Notice: Subject to any disclaimer, the term of this patent is extended or adjusted under 35 U.S.C. 154(b) by 1127 days.

(21) Appl. No.: 12/300,471

(22) PCT Filed: Apr. 17, 2007

(86) PCT No.: PCT/EP2007/003374

§ 371 (c)(1),
(2), (4) Date: Nov. 12, 2008

(87) PCT Pub. No.: WO2007/131588

PCT Pub. Date: Nov. 22, 2007

(65) Prior Publication Data

US 2009/0111356 A1 Apr. 30, 2009

(30) Foreign Application Priority Data

May 17, 2006 (DE) ..... 10 2006 023 131

(51) Int. Cl.
*A63H 17/00* (2006.01)
*B61L 23/34* (2006.01)

(52) U.S. Cl. ..... 446/465; 446/444; 446/456; 246/122 R; 246/122 A

(58) Field of Classification Search ..... 446/454–456, 446/463, 433, 465–467; 463/58, 63, 68; 246/122 A, 124, 1 R, 187 A, 186, 122 R
See application file for complete search history.

(56) References Cited

U.S. PATENT DOCUMENTS

| | | | | |
|---|---|---|---|---|
| 6,109,186 | A * | 8/2000 | Smith et al. | 104/295 |
| 6,908,066 | B2 * | 6/2005 | Koenig | 246/122 A |
| 7,264,207 | B2 * | 9/2007 | Young et al. | 246/1 R |
| 2003/0155470 | A1 * | 8/2003 | Young et al. | 246/122 A |
| 2006/0073760 | A1 * | 4/2006 | Tremel et al. | 446/454 |

FOREIGN PATENT DOCUMENTS

| | | |
|---|---|---|
| DE | 36 18 530 A1 | 12/1987 |
| DE | 203 15 048 U1 | 12/2003 |

* cited by examiner

*Primary Examiner* — Dmitry Suhol
*Assistant Examiner* — Alex F.R.P. Rada, II
(74) *Attorney, Agent, or Firm* — DeLio & Peterson, LLC; Robert Curcio

(57) ABSTRACT

The invention relates to a method for operating a digital control system for track-guided toy vehicles (10), with at least two tracks (24, 26), wherein at least one set of points (34) is provided. Accordingly in each case a switching command given for a particular toy vehicle is transmitted for switching a set of points, which this toy vehicle will next cross, into the switched state in the digital control system together with a digital address of the toy vehicle to which the switching command applies; at least the toy vehicle for which a switching command is transmitted broadcasts an identifier representing the digital address of this toy vehicle in the digital control system, wherein each set of points receives a broadcast identifier from the toy vehicle that is approaching these points and compares it with the digital address of one or more transmitted switching commands and switches the points into the switched state if the digital address in the identifier of the toy vehicle received is identical to a digital address for which a switching command is transmitted in the digital control system.

21 Claims, 1 Drawing Sheet

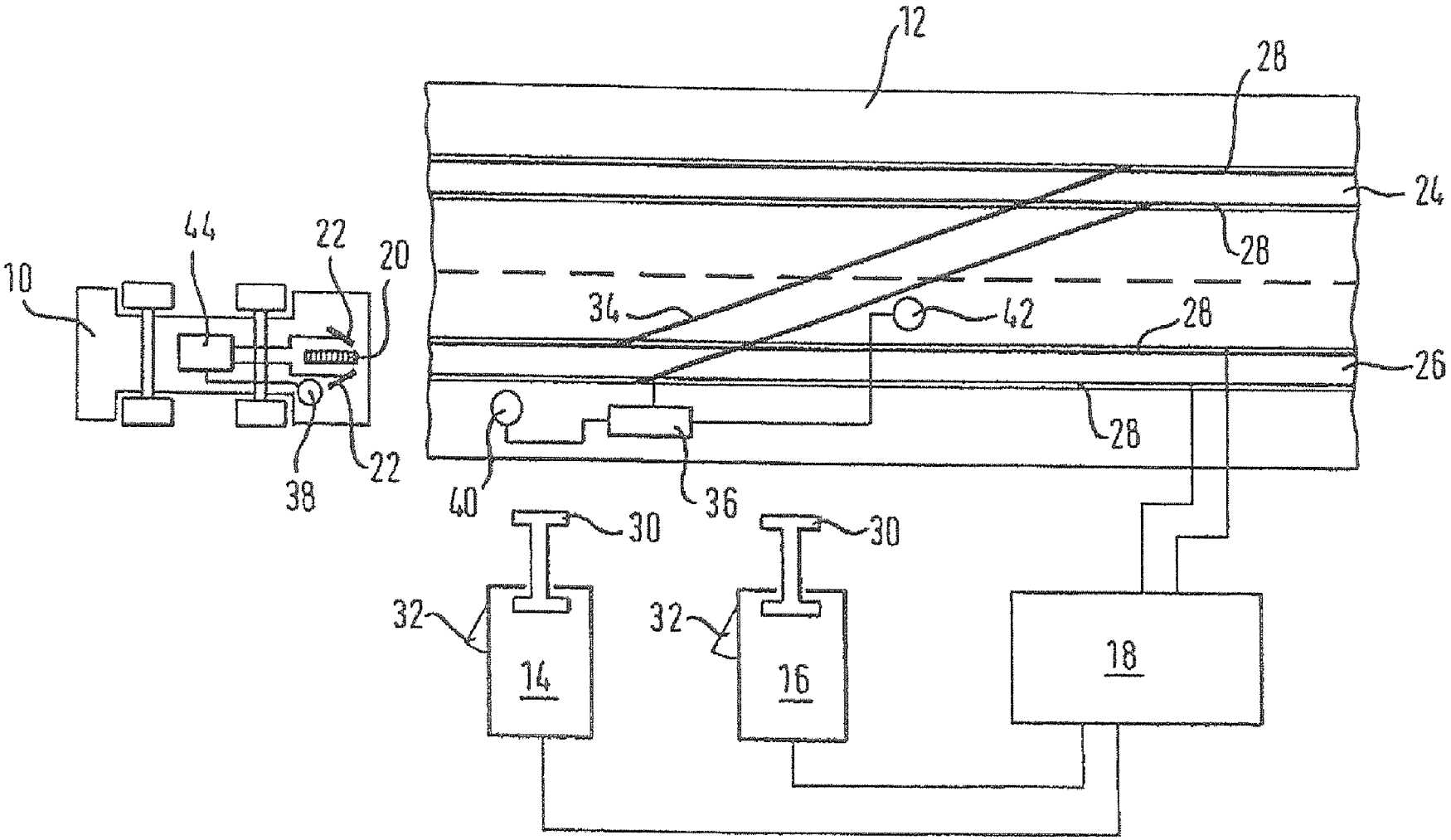
24
26
28
28
28
28
18
42
12
30
16
36
32
34
30
14
40
32
20
22
22
38
44
10

METHOD FOR SWITCHING POINTS IN A DIGITAL CONTROL SYSTEM FOR TRACK-GUIDED TOY VEHICLES

This application is a National Phase filing of PCT/EP/2007/003374 filed Apr. 17, 2007, under 35 U.S.C. §371, and claims priority to German Application No. DE 10 2006 023 131.7 filed May 17, 2006.

This invention concerns a process for operating a digital control system for track-guided toy vehicles, with at least two tracks, especially for toy vehicles on an car race track with at least two guide slots as tracks, where at least one switch is provided which, in the switched condition, optionally connects two tracks to each other in such a manner that a toy vehicle, when passing over the switch, changes from one track to another track, and which, in the unswitched condition, continues to guide the toy vehicle on the same track without changing tracks, in accordance with the main concept of Claim 1. The invention also concerns a digital control system for track-guided toy vehicles with at least two tracks, especially for toy vehicles on an car race track with at least two guide slots as tracks, where at least one switch is provided which, in the switched condition optionally connects two tracks to each other in such a manner that a toy vehicle, when passing over the switch, changes from one track to another track, and which, in the unswitched condition, continues to guide the toy vehicle on the track without changing tracks, where at least one track has a digital decoder which is connected to a setting device for the switch and the digital control system in accordance with the main concept of Claim 11. The invention also concerns a switch for a digital control system for track-guided toy vehicles with at least two tracks, especially for toy vehicles on a car race track with at least two guide slots as tracks, where the switch in the switched condition optionally connects two tracks to each other in such a manner that a toy vehicle, when passing over the switch, changes from one track to another, and, in the unswitched condition, continues to guide the toy vehicle on the same track without changing tracks, where the switch includes a digital decoder which is connected to a setting device for the switch and the digital control system in accordance with the main concept of Claim 17. The invention also involves a toy vehicle for such a control system for track-guided toy vehicles in accordance with main concept of Claim 21.

Until now, for example, it is known in the case of digitally controlled model railroads how to control the switches of the track layout from a central switch control in order to guide a train onto a desired stretch of track. For this purpose, in accordance with the large example, a switch path is set and only then is the corresponding track segment released for a train to use. In certain applications, for example, digitally controlled car race tracks for track-guided toy vehicles, this process cannot be used, since a race is a highly dynamic process. Each driver or player who guides a toy vehicle over a car race track decides quickly and on short notice with respect to the course of the toy vehicle controlled by him. To the extent that a switch is provided for changing the guide slot of the race track, each player can individually decide whether or not the switch is to be switched for his vehicle. In this regard, the high speed and possibly short intervals of toy vehicles must be taken into account for the control of the switch.

The problem to be solved by the invention is to design a process, a digital control system, a switch and a toy vehicle of the above type in such a fashion that each player possesses a reliable and dependable switch control which makes available a track change only for the desired toy vehicle.

This problem is solved by the invention through a procedure of the above-mentioned type with the characteristics characterized in Claim 1, through a digital control system of the above-mentioned type, with the characteristics characterized in Claim 11, by a switch of the above-mentioned type with the characteristics characterized in Claim 17, and by a toy vehicle of the above-mentioned type with the characteristics characterized in Claim 21. Advantageous embodiments of the invention are described in the further claims.

In the case of a process of the above-mentioned type, the invention provides that, in each case, a switching command issued for a specific toy vehicle to switch a switch, which this toy vehicle will be the next to pass over, into the switched condition, is transmitted in the digital control system together with a digital address of the toy vehicle for which the switching command is applied; that at least the toy vehicle for which a switching command is transmitted transmits an identification which represents the digital address or another encoding of this toy vehicle in the digital control system, that each switch receives an identification signal transmitted by the toy vehicle which is approaching this switch and compares it to the digital address of one or more transmitted switching commands, and that the switch changes to the switched condition if the digital address in the identification received of the toy vehicle is identical to a digital address for which a switching command is transmitted in the digital control system.

This has the advantage that in a simple and reliable manner a switching of switches for a certain toy vehicle is accomplished, where a travel course can be determined individually by each player for his toy vehicle.

In order to return the switch to its original position, after the toy vehicle which was to change tracks has passed over it, the invention provides that a switch which is in the switched condition again receives and evaluates the identification of the toy vehicle immediately after the switch in the direction of travel, and changes from the switched condition back into the unswitched condition if the identification received from the toy vehicle has the digital address for which the switch was previously changed into the switched condition. In this manner, it is also assured that the switch changes back into the unswitched condition only after the toy vehicle that is changing tracks has completely passed over the switch. Alternatively, the switch return can be actuated mechanically by the vehicle.

For a rapid and reliable comparison of the digital address, for example for each switching command transmitted in the digital control system, the digital address transmitted with this switching command is stored in each switch, where it would be useful to delete the stored digital address as soon as the associated switching command is no longer transmitted and/or upon the expiration of a predetermined period of time.

In a preferred embodiment, the identification of the toy vehicle is transmitted to the switch optically. For example, the optical transmission is carried out through an infrared diode in the toy vehicle to at least one infrared detector, especially a phototransistor in the switch.

It is useful for the identification to be transmitted constantly by each toy vehicle. Alternatively, the identification of a toy vehicle is transmitted for a predetermined time only when the toy vehicle passes a predetermined mark. This mark is, for example, a section of the track in which the energy transmission to the toy vehicle is interrupted. In both cases, the transmission sent can additionally be used for an individual lap count of each toy vehicle which detects each toy vehicle at a certain point, decodes its identification and performs corresponding calculations concerning, for example, lap time, average speed and ranking position in a race.

In a further alternative embodiment, the identification of the toy vehicle is transmitted only when and for the time that this toy vehicle is transmitting a switching command.

In the case of a digital control system of the above-mentioned type, it is provided, according to the invention, that at least one switch in addition to the digital decoder has a first receiving unit which is connected to the digital decoder and is arranged and constructed in such a manner that this first receiving unit receives an identification transmitted from a toy vehicle and forwards it to the digital decoder of the switch before the toy vehicle passes over the switch.

This has the advantage that a switch operation can be accomplished separately for each toy vehicle on the race track, depending upon individual identification of a toy vehicle and depending upon which switch the toy vehicle crosses next.

In order to assure a reliable resetting of the track after a track change by a toy vehicle, at least one switch has, in addition to the digital decoder and the first receiving unit, a second receiving unit which is connected to the digital decoder and is arranged and constructed in such a way that this second receiving unit receives an identification signal transmitted by a toy vehicle and forwards it to the digital decoder of the switch after the vehicle has passed over the switch.

For example, the first and/or second receiving unit is constructed as a phototransistor. Alternatively, the track resetting can also be actuated mechanically by the vehicle.

It is advantageous for at least one toy vehicle to include a transmitting device, which is constructed in such a manner that it transmits an individual toy vehicle identification signal.

For example, the transmitting unit is constructed as an infrared diode.

In the case of a switch of the above-mentioned type, it is provided, according to the invention, for the switch to include, in addition to the digital decoder, a first receiving unit which is connected to the digital decoder and arranged and constructed in such a manner that this first receiving unit receives an individual toy vehicle identification transmitted from a toy vehicle and forwards it to the digital decoder of the switch before the toy vehicle passes over the switch.

This has the advantage that a switch operation can be accomplished separately for each toy vehicle on the race track, depending upon individual identification of a toy vehicle and depending upon which switch the toy vehicle crosses next.

In order to assure a reliable resetting of the track after a track change by a toy vehicle, the switch has, in addition to the digital decoder and the first receiving unit, a second receiving unit which is connected to the digital decoder and is arranged and constructed in such a way that this second receiving unit receives an identification signal transmitted by a toy vehicle and forwards it to the digital decoder of the switch after the vehicle has passed over the switch.

For example, the first and/or second receiving unit is constructed as a phototransistor.

In a toy vehicle of the above-mentioned type, the invention provides for the toy vehicle to include a transmitting unit, which is constructed in such a manner that it transmits an identification of the individual toy vehicle.

This has the advantage that, in the digital control system, a vehicle recognition as well as a positional recognition of the toy vehicle is possible.

For example, the transmitting device includes an infrared diode and/or a digital decoder.

The invention is described in greater detail in the following on the basis of the drawing. This shows in its sole FIGURE an example of a schematic representation of a digital control system for track-guided toy vehicles on a car race track.

The digital control system represented schematically in the sole FIGURE for a track-guided toy vehicle 10 on a car race track 12 includes operating units 14 and 16, hereinafter called manual control units, which are connected to a central control unit 18. Each toy vehicle 10 has a guide keel 20, current shoe 22 and a digital decoder 44 connected to the current shoe 22. The guide keel 20 is constructed to fit into one of two guide slots 24, 26 on the car race track 12. On the car race track 12, at least two current rails 28 are placed next to each guide slot in each case in a known manner as energy sources for the toy vehicles 10, where, in the case of a toy vehicle 10 placed on the car race track 12, the current shoes 22 establish an electrical contact with the current rails 28. Through the current rails 28 and the current shoes 22, the toy vehicle 10, the digital decoder 44 and further electrical components as well as a drive motor (not represented) are provided with electrical power.

Each operating unit 14, 16 includes an actuating element in the form of a pestle 30 and a second actuating element in the form of a switch 32. The pestle 30 can be moved manually without steps between a first position, in which it protrudes from the operating unit 14, 16, and a second position in which it is pushed into the operating unit 14, 16. At the same time, the pestle 30 is subjected to spring force which presses the pestle 30 into the first position and can be pushed to the second position without steps, against the spring force. The switch 32 can be manually switched between a first and a second position, where spring force pushes the switch 32 into the first position. The switch 32 can be pushed by manual actuation against the spring force into the second position.

In the known manner, the control of the toy vehicle 10 by means of the operating unit 14, 16 is done in such a manner that the speed of the toy vehicle 10 is controlled using the pestle 30. The further the pestle 30 is pressed into each operating unit 14, 16, the higher the speed of the toy vehicle 10 assigned to this operating unit 14, 16. In the second position of the pestle 30, the assigned toy vehicle 10 has maximum speed, and in the first position of the pestle 30, the assigned toy vehicle has a speed of 0, that is, the toy vehicle 10 stands still.

In the digital control system, each operating unit 14, 16 is unambiguously assigned to one toy vehicle 10, so that each player who holds an operating unit 14, 16 in his hand controls a toy vehicle 10 around the car race track. For this purpose, the operating units 14, 16 are connected to the control center 18. This latter translates the position of the actuating elements 30, 32 of each operating unit 14, 16 into digitally encoded signals or data packets and adds to each digitally encoded signal or data packet a digital address, which identifies a specific operating unit 14, 16. The control center 18 sends the data packets through the current rails 28 of the car race track 10 [sic] so that it is received in each toy vehicle 10 through the current shoes 22 and forwarded to the digital decoder 44 in each case. In the digital decoders 44, the digitally encoded signals or data packets are evaluated, where first the digital address is read in each case. In the digital decoder 44 of each toy vehicle 10, a digital address is stored and the digital decoder 44 of the toy vehicle 10 compares the digital address of each data packet received to the stored digital address. If the two agree, then the digital decoder 44 of the toy vehicle 10 identifies the corresponding data packet as belonging to this toy vehicle 10 and evaluates the digitally encoded data contained in the data packet. Corresponding to these data, the digital decoder 44 of the toy vehicle 10 gives control commands to the toy vehicle 10, especially with respect to speed.

Furthermore, the car race track 12 includes a switch 34, which connects the track or guide slot 26 with the track or guide slot 24, where the switch 34 has two conditions, namely a switched condition, in which the switch 34 guides a toy vehicle 10 passing over it from the guide slot 26 to the guide slot 24, that is, the toy vehicle 10 makes a track change, and an unswitched condition in which the switch 34 guides a toy vehicle 10 passing over it further onto the guide slot 26, that is, the toy vehicle 10 does not change the track or guide slot. Each switch 34 in its basic position is in the unswitched condition, so that any toy vehicle 10 passing over the switch 32 fundamentally remains in the track 26. A track change of a toy vehicle 10 can be triggered by the player driving this toy vehicle with his operating unit or manual control unit 14, 16 by the player pressing the switch 32 and holding it down until his toy vehicle 10 has passed over the next switch. The pressing of the switch 32 on, for example, the manual control unit 14 which is assigned to the toy vehicle 10, causes the control center 18 to send out a switch command, together with the digital address of the manual control unit 14, as a digitally encoded data packet through the current rails 28. This data packet is repeated for the length of time, for example, in a predetermined time raster, as the player holds the switch 32 down. The data packets thus sent are received and evaluated by corresponding digital decoders 36 in each switch 34, so that each switch 34 contains the information as to which digital address(s) have one or more switching commands present.

According to the invention, each toy vehicle 10 transmits an identification through a transmitting unit 38, which contains the digital address of the toy vehicle 10 and therefore also the digital address of the associated manual control unit 14, 16. Each switch 34 includes a corresponding first receiving unit 40, which receives the identification transmitted by the toy vehicle 10, before the toy vehicle 10 passes over the switch 34. The digital decoder 36 in the switch 34 evaluates the identification and compares the digital address contained in the identification with all digital addresses for which a switching command is present, that is, with all digital addresses from manual control units 14, 16 in which the switch 32 is pressed. If the digital address of the identification of the toy vehicle 10 approaching the switch 34 agrees with one of the digital addresses for which switching commands are being transmitted in the digital control system, then the digital decoder 36 switches the switch 34 into the switched condition and the vehicle approaching the switch 34 and passing over it changes from track 26 to track 24. At least one or all switches 34 also include a second receiving device 42, which is located after the switch 34 but in the area of the transition from the first track 26 to the second track 24. This second receiving device 42 receives the identification transmitted from the toy vehicle 10 for a second time after the toy vehicle 10 has passed over the switch 34, determines the digital address contained therein and compares it with the digital address for which the switch 34 was previously changed to the switched condition. If this digital address agrees with the one for which the switch 34 was previously switched to the switched condition, then the digital decoder 36 switches the switch 34 back into the unswitched condition. This makes it possible for even two closely following toy vehicles 10 to be controlled by their players in such a manner that the toy vehicles 10 independently of each other optionally and in a reliable manner can each change tracks or not change tracks independently of each other.

In the embodiment represented, by way of an example, the transmitting device 38 in each toy vehicle is constructed as an infrared diode and the first and second receiving units 40, 42 as phototransistors. The invention is however not limited to this embodiment cited by way of example. The identification can also be transmitted electronically over the current rails 28 or through a radio connection of the toy vehicles 10 to the digital decoders 36 in the switches 34 instead of through an optical transmission path.

The transmission of the identification can be done by each toy vehicle 10 in different ways. In a first embodiment, all toy vehicles 10 constantly transmit their individual identification through the transmitting unit 38. In an alternative embodiment, on the car race track 12, short segments without power are provided, that is, segments of one of the current rails 28 which are separated from the electrical power supply. This short separation and reconnection of the digital decoder 44 in the toy vehicle 10 from and to the electrical power supply then initiates the transmission of the identification by the transmitting unit 38 for a predetermined period of time. It is useful in this case to provide such a powerless segment of a current rail 28 before each receiving unit 40, 42. In a further embodiment, the digital decoders 44 in the toy vehicles 10 evaluate the digitally transmitted switching commands. As soon as the digital decoder 44 in a toy vehicle 10 receives a switching command with a digital address that is identical to its own digital address, that is, the player who controls this toy vehicle 10 has pressed the switch 32 on his manual control unit 14, the toy vehicle 10 transmits its identification. As soon as the player releases the switch 32, the transmission of the switching command ceases and the associated toy vehicle 10 ceases to transmit its identification. The above-mentioned different embodiments can also be combined with each other in any manner.

The resetting of the switch can also be actuated mechanically by the vehicle.

The invention claimed is:

1. A process for operating a digital control system for track-guided toy vehicles, having at least two tracks for toy vehicles on a car race track with at least two guide slots as the tracks, including at least one switch where in the switched condition, optionally connects two tracks to each other in such a manner that a toy vehicle, when passing over the switch, changes from one track to another track, and which, in the unswitched condition, continues to guide the toy vehicle on the same track without changing tracks, where, in each case a switching command issued for a certain toy vehicle to switch a switch which the certain toy vehicle will be the next to cross is transmitted in the switched condition in the digital control system together with a digital address of the certain toy vehicle for which the switching command is valid; including at least one toy vehicle, for which a switching command is transmitted, transmits an identification which represents the digital address or another encoding of said at least one toy vehicle in the digital control system; that each switch receives an identification transmitted by the toy vehicle which is approaching this switch and compares it to the digital address of one or more transmitted switching commands and that the switch changes into the switched condition if the digital address in the identification received from the toy vehicle is identical to a digital address for which a switching command is transmitted in the digital control system.

2. The process of claim 1 wherein a switch which is in the switched condition again receives the identification of vehicles after the switch in the direction of travel and evaluates the identification and changes back from the switched condition into the unswitched condition if the identification received from the toy vehicle contains the digital address for which the switch previously changed into the switched condition.

3. The process of claim 2 including having the identification of the toy vehicle transmitted optically to the switch.

4. The process of claim 1 including for each switching command transmitted in the digital control system, the digital address transmitted with this switching command is stored in each switch.

5. The process of claim 4 including deleting the stored digital address as soon as the associated switch command is no longer transmitted and/or as soon as a predetermined period of time has passed.

6. The process of claim 1 including having the identification of the toy vehicle transmitted optically to the switch.

7. The process of claim 6 wherein the optical transmission is accomplished through an infrared diode in the toy vehicle to at least one infrared detector, especially a phototransistor in the switch.

8. The process of claim 1 including having the identification of each toy vehicle transmitted continuously.

9. The process of claim 1 including having the identification of a vehicle transmitted only for a predetermined time when the vehicle passes a predetermined marking.

10. The process of claim 9 wherein the marking is a segment of track in which the power transmission to the toy vehicle is interrupted.

11. The process of claim 1 including having the identification of a toy vehicle transmitted only when and as long as a switching command is transmitted for this vehicle.

12. A digital control system for track-guided toy vehicles with at least two tracks for toy vehicles on a car race track with at least two guide slots as tracks, where at least one switch is provided which, in the switched condition optionally connects two tracks to each other in such a manner that a toy vehicle, when passing over the switch, changes from one track to another track, and which, in an unswitched condition, continues to guide the toy vehicle on the track without changing tracks, where at least one track has a digital decoder which is connected to a setting device for the switch and the digital control system including at least one switch in addition to the digital decoder having a first receiving unit which is connected to the digital decoder and arranged and constructed in such a manner that the first receiving unit receives an identification transmitted from a toy vehicle, which contains a digital address of the toy vehicle, and forwards it to the digital decoder of the switch before the toy vehicle passes over the switch.

13. The digital control system of claim 12 including having the first receiving unit constructed as a phototransistor.

14. The digital control system of claim 12 including the at least one switch, in addition to the digital decoder and the first receiving unit, having a second receiving unit which is connected to the digital decoder and is arranged and constructed in such a manner that this second receiving unit receives an identification transmitted by the toy vehicle and forwards it to the digital decoder of the switch, after the toy vehicle has passed over the switch.

15. The digital control system of claim 14 including having the second receiving unit constructed as a phototransistor.

16. The digital control system of claim 12 wherein at least one toy vehicle includes a transmitting unit to transmit an individual toy vehicle identification.

17. The digital control system of claim 16 including having the transmitting unit constructed as an infrared diode.

18. A switch for a digital control system for track-guided toy vehicles having at least two tracks for toy vehicles on a car race track with at least two guide slots as tracks, where the switch in the switched position optionally connects two tracks to each other in such a manner that a toy vehicle, when passing over the switch, changes from one track to another track, and, in the unswitched position, continues to guide the toy vehicle on the same track without changing tracks, where the switch includes a digital decoder which is connected to a setting device for the switch and the digital control system including the switch, in addition to the digital decoder, having a first receiving unit which is connected to the digital decoder as well as arranged and constructed in such a manner that the first receiving unit receives an individual vehicle identification transmitted by the toy vehicle, which contains a digital address of the toy vehicle, and forwards it to the digital decoder of the switch before the toy vehicle passes over the switch.

19. The switch of claim 18 including having the first receiving unit constructed as a phototransistor.

20. The switch of claim 18 wherein the switch in addition to the digital decoder and the first receiving unit includes a second receiving unit which is connected to the digital decoder as well as being arranged and constructed in such a manner that this second receiving unit receives an identification transmitted by the toy vehicle and forwards it to the digital decoder of the switch after the toy vehicle has passed over the switch.

21. The switch of claim 20 including having the second receiving unit constructed as a phototransistor.

* * * * *